US011217093B2

(12) United States Patent
Nguyen et al.

(10) Patent No.: US 11,217,093 B2
(45) Date of Patent: Jan. 4, 2022

(54) ELECTRONIC COMMUNICATION DEVICE, RELATED MONITORING APPARATUS, SUPERVISION INSTALLATION, COMMUNICATION METHOD AND COMPUTER PROGRAM

(71) Applicant: TRANSDEV GROUP, Issy les Moulineaux (FR)

(72) Inventors: Kien Cuong Nguyen, Antony (FR); Alexis Beauvillain, Massy (FR)

(73) Assignee: Transdev Group, Issy les Moulineaux (FR)

( * ) Notice: Subject to any disclaimer, the term of this patent is extended or adjusted under 35 U.S.C. 154(b) by 0 days.

(21) Appl. No.: 16/856,939

(22) Filed: Apr. 23, 2020

(65) Prior Publication Data

US 2020/0342755 A1 Oct. 29, 2020

(30) Foreign Application Priority Data

Apr. 25, 2019 (FR) ..... 19 04351

(51) Int. Cl.

| | |
|---|---|
| ***G08G 1/08*** | (2006.01) |
| ***G08G 1/0967*** | (2006.01) |
| ***G08G 1/16*** | (2006.01) |
| *G08G 1/01* | (2006.01) |

(52) U.S. Cl.

CPC ..... *G08G 1/08* (2013.01); *G08G 1/096783* (2013.01); *G08G 1/096791* (2013.01); *G08G 1/166* (2013.01); *G08G 1/0112* (2013.01); *G08G 1/096716* (2013.01)

(58) Field of Classification Search

CPC .. G08G 1/00; G08G 1/01; G08G 1/07; G08G 1/08; G08G 1/16; G06F 17/00; B60W 30/00; B60W 30/143; B60W 30/146; B60W 30/16; B60W 30/162

See application file for complete search history.

(56) References Cited

U.S. PATENT DOCUMENTS

| | | | | |
|---|---|---|---|---|
| 10,235,882 | B1 | 3/2019 | Aoude et al. | |
| 2008/0154629 | A1 | 6/2008 | Breed et al. | |
| 2008/0167821 | A1* | 7/2008 | Breed | G08G 1/161 701/301 |
| 2010/0250021 | A1 | 9/2010 | Cook et al. | |
| 2012/0059574 | A1 | 3/2012 | Hada | |

(Continued)

OTHER PUBLICATIONS

French Search Report for Application No. FR1904351, dated Jan. 9, 2020, in 2 pages.

*Primary Examiner* — Van T Trieu

(74) *Attorney, Agent, or Firm* — Knobbe, Martens, Olson & Bear, LLP

(57) ABSTRACT

An electronic communication device is able to be coupled to a sensor and is intended to be installed in the road or embedded in a vehicle. The device includes a determining module configured to determine a tracking list for at least one traffic element detected by the sensor. Each tracking list includes several information elements. The traffic element is located within a geographical zone covered by the sensor. A computer is configured to compute, as a function of at least one determined tracking list, a motion limitation setpoint for each vehicle located in the geographical zone. A transmitter is configured to send the computed limitation setpoint(s) to an electronic supervision equipment item via a data link.

12 Claims, 2 Drawing Sheets

(56) References Cited

U.S. PATENT DOCUMENTS

| | | | | |
|---|---|---|---|---|
| 2012/0116659 | A1* | 5/2012 | Yuasa | G08G 1/096741 701/118 |
| 2012/0277967 | A1* | 11/2012 | Isaji | B60W 50/0098 701/96 |
| 2013/0110371 | A1* | 5/2013 | Ogawa | G08G 1/09623 701/70 |
| 2014/0207357 | A1* | 7/2014 | Shimotani | B60K 31/00 701/93 |
| 2017/0369067 | A1* | 12/2017 | Saigusa | B60W 30/18163 |
| 2020/0298842 | A1* | 9/2020 | Takamatsu | B60W 60/001 |

* cited by examiner

ELECTRONIC COMMUNICATION DEVICE, RELATED MONITORING APPARATUS, SUPERVISION INSTALLATION, COMMUNICATION METHOD AND COMPUTER PROGRAM

CROSS-REFERENCE TO RELATED APPLICATIONS

This application is a U.S. non-provisional application claiming the benefit of French Application No. 19 04351, filed on Apr. 25, 2019, which is incorporated herein by reference in its entirety.

FIELD OF THE INVENTION

The present invention relates to an electronic communication device able to be coupled to a sensor and intended to be installed in the road infrastructure or embedded in a vehicle.

The invention also relates to a monitoring apparatus comprising such a device.

The invention also relates to a supervision installation of a transport system including at least one motor vehicle, the supervision installation comprising at least a monitoring apparatus and an electronic supervision equipment item coupled to each monitoring apparatus, the supervision equipment item being configured to transmit at least one instruction to a respective motor vehicle.

The invention also relates to a communication method, the method being implemented by such an electronic communication device.

The invention also relates to a non-transitory computer readable medium including a computer program including software instructions which, when implemented by a computer, implement such a communication method.

The invention relates to the field of the secure driving of motor vehicles, and in particular the field of the automatic driving of autonomous motor vehicles.

Indeed, in the field of the secure driving of motor vehicles, and in particular in autonomous driving, one of the main problems is the early identification of obstacles on the path of a moving vehicle, making it possible to take corrective measures so that the vehicle does not strike these obstacles.

The considered obstacles are of any type, for example fixed obstacles, such as guardrails, parked cars, or moving obstacles, for example other vehicles or pedestrians. It is understood that it is critical to avoid any collision between a moving vehicle and such obstacles.

BACKGROUND OF THE INVENTION

Driving assistance systems for an automobile are known comprising communication devices able to identify obstacles in a road travel zone via sensors and to inform a remote electronic equipment item. The electronic equipment item is able to determine and transmit an instruction to a vehicle traveling in said road travel zone.

However, when many obstacles are located in the zone where the vehicle is traveling, the connection between the communication device and the remote electronic equipment item risks being saturated, which can be critical for the safety of the vehicle and/or surrounding obstacles.

SUMMARY OF THE INVENTION

The aim of the invention is to address the drawbacks of the state of the art by proposing an effective communication device, even in case of a large number of obstacles in the zone where the vehicle is traveling.

To that end, the invention relates to an electronic communication device able to be coupled to a sensor and intended to be installed in the road infrastructure or embedded in a vehicle, the communication device comprising:

- a determining module configured to determine a tracking list for at least one traffic element detected by the sensor, each tracking list including several information elements, the traffic element being located within a geographical zone covered by the sensor,
- a computer or computing module configured to compute, as a function of at least one determined tracking list, a motion limitation setpoint for each vehicle located in the geographical zone; and
- a sending module, such as a transmitter, configured to send the computed limitation setpoint(s) to an electronic supervision equipment item via a data link.

Thus, with the communication device according to the invention, the computing module configured to compute, as a function of at least one determined tracking list, a motion limitation setpoint for each vehicle located in the geographical zone; then the sending module makes it possible to send the computed limitation setpoint(s) to the supervision equipment item.

The quantity of information thus transmitted to the supervision equipment item is then reduced relative to a communication device of the state of the art transmitting all of the information elements contained in the determined tracking list(s). Each motion limitation setpoint indeed has a data size, for example expressed in bits or bytes, smaller than the size of the tracking list(s) from which it is calculated.

The communication device according to the invention is then particularly advantageous in the zones having a large number of obstacles, in particular the zones where many vehicles and pedestrians cohabitate.

According to other advantageous aspects of the invention, the electronic communication device comprises one or more of the following features, considered alone or according to all technically possible combinations:

- the communication device further comprises an acquisition module configured to acquire at least one setpoint computing rule, from an electronic apparatus, preferably from the electronic supervision equipment item; and the computing module is configured to compute the motion limitation setpoint further as a function of the at least one acquired computing rule;

- the motion limitation setpoint is chosen from the group consisting of: a speed limitation setpoint; an acceleration limitation setpoint; and a speed and acceleration limitation setpoint;
- the determining module is configured to determine, for each traffic element, at least one information element chosen from the group consisting of: the type of traffic element, such as pedestrian, stationary obstacle, motor vehicle or bicycle; the position of the traffic element; at least one dimension of the traffic element; a speed of the traffic element; an acceleration/deceleration of the traffic element; and a confidence index associated with the traffic element;
- the communication device further comprises a switch or switching module configured to switch the sending module between a first sending mode according to which the sending module transmits the computed limitation setpoint(s) to the electronic supervision equipment item and a second sending mode according to which the sending module transmits at least part of each tracking list to the electronic supervision equipment item; and the switching module is configured to evaluate a charge of the data link between the sending module and the electronic supervision equipment item, and to switch the sending module to the first sending mode if a charge of the data link is detected above a predefined charge threshold.

The invention also relates to a monitoring apparatus comprising a sensor and an electronic communication device able to be coupled to said sensor, the communication device being as defined above.

The invention also relates to a supervision installation of a transport system including at least one motor vehicle, the supervision installation comprising:

at least a monitoring apparatus intended to be installed in the road infrastructure or on a corresponding motor vehicle; and an electronic supervision equipment item coupled to each monitoring apparatus, the supervision equipment item being configured to transmit at least one instruction to a respective motor vehicle;

wherein at least one monitoring apparatus is as defined above.

According to one advantageous aspect of the invention, the supervision installation comprises the following feature:

the electronic supervision equipment is configured to establish a resulting motion limitation setpoint for a geographical zone from one or several motion limitation setpoints received for said geographical zone.

The invention also relates to a communication method, the method being implemented by an electronic communication device able to be coupled to a sensor intended to be installed in the road infrastructure or on a vehicle, the method comprising:

determining a tracking list for at least one traffic element detected by the sensor, each tracking list including several information elements, the traffic element being located within a geographical zone covered by the sensor, computing, as a function of at least one determined tracking list, a motion limitation setpoint for each vehicle located in the geographical zone; and sending the computed limitation setpoint(s) to an electronic supervision equipment item via a data link.

The invention also relates to a non-transitory computer readable medium including a computer program including software instructions which, when implemented by a computer, implement a communication method as defined above.

BRIEF DESCRIPTION OF THE DRAWINGS

These features and advantages of the invention will appear more clearly upon reading the following description, provided solely as a non-limiting example, and done in reference to the appended drawings, in which.

DETAILED DESCRIPTION OF PREFERRED EMBODIMENTS

Figure 1:
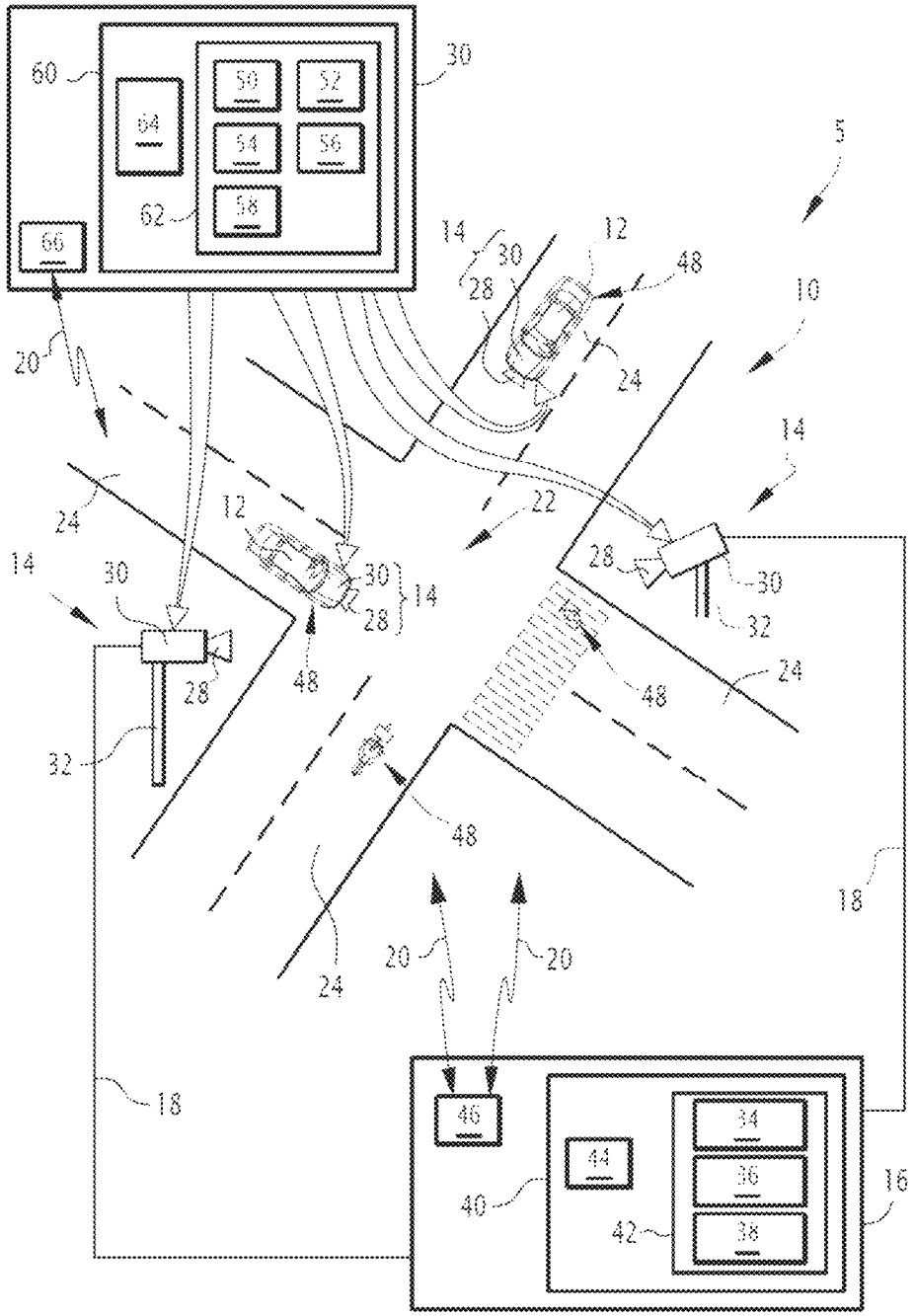
FIG. 1 is a schematic illustration of a supervision installation of a transport system according to the invention, the supervision installation comprising at least one monitoring apparatus intended to be installed in the road infrastructure or on a motor vehicle and an electronic supervision equipment item coupled to each monitoring apparatus, each monitoring apparatus including a sensor and an electronic communication device coupled to said sensor.

In FIG. 1, a supervision installation 5 is configured to supervise a transport system 10 including a fleet of motor vehicle(s) 12. Among the fleet of motor vehicle(s) 12, at least one motor vehicle 12 is an autonomous motor vehicle. The fleet preferably includes a plurality of motor vehicles 12, each motor vehicle 12 preferably being an autonomous motor vehicle.

The supervision installation 5 comprises at least one monitoring apparatus 14 intended to be installed in the road infrastructure or on a corresponding motor vehicle 12, and an electronic supervision equipment item 16 coupled to each surveillance apparatus 14, the supervision equipment item 16 being configured to transmit at least one setpoint to a respective motor vehicle 12.

In the example of FIG. 1, the supervision installation 5 comprises a plurality of surveillance apparatuses 14, some of them being installed in the road infrastructure and then typically being coupled to the supervision equipment item 16 via a wired datalink 18, and others embedded in a corresponding motor vehicle 12 and then typically being coupled to the supervision equipment item 16 via a wireless datalink 20. In a variant, each surveillance apparatus 14 is coupled to the electronic supervision equipment item 16 via a respective wireless link 20.

Each motor vehicle 12 is known in itself and is able to travel within a road infrastructure 22 including one or several traffic lanes 24, visible in FIG. 1.

When the autonomous vehicle 12 is an autonomous motor vehicle, it preferably has a level of automation greater than or equal to 3 on the scale of the Organisation Internationale des Constructeurs Automobiles (OICA). The level of automation is then equal to 3, that is to say, a conditional automation, or equal to 4, that is to say, a high automation, or equal to 5, that is to say, a full automation.

According to the OICA scale, level 3 for conditional automation corresponds to a level for which the driver does not need to perform continuous monitoring of the driving environment, while still having to be able to take back control of the autonomous motor vehicle. According to this level 3, a system for managing the autonomous driving, embedded in the autonomous motor vehicle 12A, then performs the longitudinal and lateral driving in a defined usage case and is capable of recognizing its performance limits to then ask the driver to take back dynamic driving with a sufficient time margin.

The high level of automation 4 then corresponds to a level for which the driver is not required in a defined usage case. According to this level 4, the system for managing the autonomous driving, embedded in the autonomous motor vehicle 12A, then performs the dynamic longitudinal and lateral driving in all situations in this defined usage case.

The full automation level 5 lastly corresponds to a level for which the system for managing the autonomous driving, embedded in the autonomous motor vehicle, performs the dynamic lateral and longitudinal driving in all situations encountered by the autonomous motor vehicle, throughout its entire journey. No driver is then required.

Each surveillance apparatus 14 comprises a sensor 28 and an electronic communication device 30 able to be coupled to said sensor 28.

Each surveillance apparatus 14 installed in the road is for example fastened to a vertical mast 32, like in the example of FIG. 1, or to a building. Each surveillance apparatus 14 installed on a motor vehicle is preferably fastened to the front of the motor vehicle 12 or on the roof of said vehicle 12.

The electronic supervision equipment 16 is able to remotely supervise, or remotely monitor, the fleet of motor vehicle(s) 12, the supervision equipment also being called CCP (Central Command Post).

The electronic supervision equipment 16 comprises a module 34 for receiving data message(s) from a surveillance apparatus 14 to which it is coupled, in particular from its electronic communication device 30, the received data message for example being a motion limitation setpoint for a geographical zone covered by the sensor 28 of the respective surveillance apparatus 14.

The electronic supervision equipment item 16 comprises a module 36 for establishing a resulting motion limitation setpoint for a geographical zone and a module 38 for transmitting setpoint(s) to a respective motor vehicle 12.

In the example of FIG. 1, the electronic supervision equipment item 16 comprises a first information processing unit 40, for example formed by a first memory 42 and a first processor 44 associated with the first memory 42. The electronic supervision equipment item 16 comprises a first transceiver 46 configured in particular to send, for example in the form of radio waves, data, such as the setpoints, transmitted by the transmission module 38 to the respective motor vehicle 12, and/or to receive, in the opposite direction, data from each surveillance apparatus 14, these received data in particular being intended for the receiving module 34.

In the example of FIG. 1, the receiving module 34, the establishing module 36 and the transmission module 38 are each made in the form of software, or a software component, executable by the first processor 44. The first memory 42 of the electronic supervision equipment item 16 is then able to store software for receiving data from each surveillance apparatus 14, software for establishing a resulting motion limitation setpoint for a given geographical zone, from the motion limitation setpoint(s) received for said geographical zone from the surveillance apparatus or apparatuses 14 associated with this zone, and software for transmitting at least one respective motor vehicle 12. The first processor 44 is then able to execute each of the software applications from among the receiving software, the establishing software and the transmitting software.

In a variant that is not shown, the receiving module 34, the establishing module 36 and the transmitting module 38 are each made in the form of a programmable logic component, such as an FPGA (Field Programmable Gate Array), or in the form of a dedicated integrated circuit, such as an ASIC (Application-Specific Integrated Circuit).

When the electronic supervision equipment item 16 is made in the form of one or several software programs, i.e., in the form of a computer program, it is further able to be stored on a medium, not shown, readable by computer. The computer-readable medium is for example a medium suitable for storing electronic instructions and able to be coupled with a bus of a computer system. As an example, the readable medium is an optical disc, a magnetic-optical disc, a ROM memory, a RAM memory, any type of non-volatile memory (for example, EPROM, EEPROM, FLASH, NVRAM), a magnetic card or an optical card. A computer program including software instructions is then stored on the readable medium.

Each sensor 28 is known in itself, and is able to detect at least one traffic element 48. Each sensor 28 is preferably chosen from the group consisting of: an image sensor, a lidar (light detection and ranging), a leddar (light-emitting diode detection and ranging), a radar (radio detection and ranging) and an ultrasonic sensor.

Each electronic communication device 30 is able to be coupled to a respective sensor 28 and intended to be installed in the road or embedded in a respective motor vehicle 12, preferably on a respective autonomous motor vehicle.

Each electronic communication device 30 comprises a module 50 for determining a tracking list for at least one traffic element 48 detected via the sensor 28, the traffic element 48 being located within a geographical zone covered by the corresponding sensor 28.

Each communication device 30 further comprises a module 52 for computing, as a function of at least one determined tracking list, a motion limitation setpoint for each vehicle 12 located in the geographical zone, and a module 54 for sending the computed limitation setpoint(s) to the electronic supervision equipment item 16 via the corresponding data link 18, 20.

As an optional addition, each communication device 30 further comprises a module 56 for acquiring setpoint computing rule(s).

Also as an optional addition, each switching device 30 further comprises a module 58 for switching the sending module 54 between the first and second sending modes.

In the example of FIG. 1, each electronic communication device 30 comprises a second information processing unit 60, for example formed by a second memory 62 and a second processor 64 associated with the second memory 62. When the electronic communication device 30 is intended to be embedded in a motor vehicle 12, it further comprises a second transceiver 66 configured to send and/or receive data in the form of radio waves, in particular with the electronic supervision equipment item 16.

In the example of FIG. 1, the determining module 50, the computing module 52 and the sending module 54, as well as, as an optional addition, the acquisition module 56 and the switching module 58, are each made in the form of software, or a software component, executable by the second processor 64. The second memory 62 of the electronic switching device 30 is then able to store software for determining a respective tracking list for at least one traffic element 48 detected via the corresponding sensor 28, software for computing, as a function of at least one determined tracking list, a motion limitation setpoint for each vehicle 12 located in the geographical zone associated with said sensor 28 and software for sending the computed limitation setpoint(s) to the electronic supervision equipment item 16 via the data link 18, 20. As an optional addition, the second memory 62 is also able to store software for acquiring, from the electronic apparatus, preferably from the electronic supervision equipment item 16, at least one setpoint computing rule; and software for switching the sending software between the first sending mode and the second sending mode.

In a variant that is not shown, the determining module 50, the computing module 52 and the sending module 54, as well as, optionally and additionally, the acquisition module 56 and the switching module 58, are each made in the form of a programmable logic component, such as an FPGA, or in the form of a dedicated integrated circuit, such as an ASIC.

When the electronic communication device 30 is made in the form of one or several software programs, i.e., in the form of a computer program, it is further able to be stored on a medium, not shown, readable by computer. The computer-readable medium is for example a medium suitable for storing electronic instructions and able to be coupled with a bus of a computer system. As an example, the readable medium is an optical disc, a magnetic-optical disc, a ROM memory, a RAM memory, any type of non-volatile memory (for example, EPROM, EEPROM, FLASH, NVRAM), a magnetic card or an optical card. A computer program including software instructions is then stored on the readable medium.

The receiving module 34 is configured to receive at least one data message from each surveillance apparatus 14 to which it is coupled, in particular from its electronic communication device 30. The received data message is for example a motion limitation setpoint computed by the respective computing module 52, then sent by the respective sending module 54.

The establishing module 36 is configured to establish the resulting motion limitation setpoint for the corresponding geographical zone, from one or several motion limitation setpoints received for said geographical zone, from one or several respective surveillance apparatuses 14. This establishment of the resulting motion limitation setpoint is known in itself, and for example depends on the motion limitation setpoint that is most restrictive, that is to say most limiting, among the different motion limitation setpoints received for said geographical zone. One skilled in the art will of course understand that if a single motion limitation setpoint is received for said geographical zone, then the resulting motion limitation setpoint is equal to this single limitation setpoint received for said zone.

The transmission module 38 is configured to transmit at least one setpoint to a respective motor vehicle 12, and is preferably configured to transmit each resulting motion limitation setpoint thus established to the motor vehicle(s) 12 located in said geographical zone, that is to say, positioned inside said geographical zone.

The determining module 50 is configured for determining the tracking list for at least one traffic element 48 detected via the sensor 28, preferably for each traffic element 48 detected via the sensor 28.

Each tracking list includes several information elements. Each information element is for example chosen from the group consisting of:

- the type of traffic element 48, such as pedestrian, stationary obstacle, motor vehicle or bicycle;
- the position of the traffic element 48;
- at least one dimension of the traffic element 48;
- a speed of the traffic element 48;
- an acceleration/deceleration of the traffic element 48; and
- a confidence index associated with the traffic element 48.

Each tracking list preferably complies with the CPM (Collective Perception Message) format, as for example described in the document titled "LC: 1.2 SPECIFICATION DU SYSTEME ET DE SES COMPOSANTS-FORMAT DES MESSAGES (Specification of the system and its components-Message Formats)", in its version V03 published on Dec. 12, 2017.

Each traffic element 48 is an element able to travel in and/or pass through a respective traffic lane 24. Each traffic element 48 is in particular an element able to be located in the respective geographical zone. Each traffic element 48 is for example chosen from the group consisting of: a motorized vehicle, such as a motor vehicle 12; a nonmotorized vehicle; a pedestrian and an animal.

The determining module 50 is configured for determining the tracking list from the measured value(s) provided by the sensor 28 relative to the detected traffic element 48. This determination of information element(s), of the type previously described and from value(s) measured by the sensor 28, is known in itself. One skilled in the art will further understand that each measured value is to be understood broadly within the meaning of a measurement done by the sensor 28 relative to the traffic element 48, and depends on the type of sensor 28.

When the sensor 28 is an image sensor, the measured value supplied by the sensor 28 is in particular an image of a scene comprising the traffic element 48, or in other words an image of the geographical zone inside which the traffic element 48 is located.

When the sensor 28 is a lidar, a leddar, a radar or an ultrasonic sensor, the measured value provided by the sensor 28 is in particular a set of measuring point(s) of the scene comprising the traffic element 48, or in other words a set of measuring point(s) of the geographical zone inside which the traffic element 48 is located. As is known in itself, this set of measuring point(s), also called measuring point cloud, is obtained by the sensor 28 through the sending of a plurality of measuring signals in different sending directions, then the reception of signals resulting from the reflection, by the environment, of the sent measuring signals, the sent measuring signals typically being light, radio, or ultrasonic signals.

The computing module 52 is configured to compute, as a function of at least one respective tracking list, the motion limitation setpoint for each vehicle 12 located in the geographical zone. The computing module 52 is typically configured to compute each motion limitation setpoint as a function of at least one computing rule.

The computed motion limitation setpoint is a speed limitation setpoint, or an acceleration limitation setpoint, or a limitation setpoint of the jerk vector, or a speed and acceleration limitation setpoint.

The safety rules are for example established based on the experience of transport operators on site and on the specific characteristics, or intrinsic characteristics, of the motor vehicles 12. For example, the intrinsic characteristics of the vehicles influence the braking distance: a car thus needs a shorter distance to brake than a public transportation vehicle, such as a shuttle or a bus.

Additionally, passengers' habits vary as a function of the vehicles. For example, passengers transported by a public transportation vehicle, such as a bus, are rarely held by seatbelts. Sudden braking must therefore be avoided with this type of vehicle, for comfort and safety reasons.

Furthermore, the safety rules are advantageously also established as a function of the sensor(s) 28. Indeed, the performance of said sensor(s) 28 may vary as a function of the weather conditions (rain, fog, sun, etc.). For example, when a sensor 28 embedded in a vehicle 12 is a lidar, the speed limit imposed on said vehicle is more restrictive, that is to say, with a lower maximum speed value, than for a vehicle 12 embedding an image sensor, wet objects being more difficult to see for a lidar than for image sensor(s), in particular infrared sensors.

As an example, some safety rules are listed below:

- speed limit setpoint at 20 km/h approaching the geographical zone, then 5 km/h within said geographical zone, if an event (presence of several pedestrians in the lane 24) is detected within said geographical zone;
- prohibition from approaching the geographical zone, and stoppage inside said geographical zone, if an agitated demonstration (presence of several pedestrians in the lane 24 and running in all directions) is detected within said geographical zone;

speed limit setpoint at 30 km/h approaching the geographical zone, if one or several pedestrians with an abnormal behavior, for example a winding behavior potentially resulting from drunkenness of the pedestrian, are detected within said geographical zone;

speed limit setpoint at 30 km/h approaching the geographical zone, if the presence of person(s) moving on skates, monocycles, or a skateboard is detected within said geographical zone;

acceleration/deceleration limitation setpoint less than or equal to 1.5 $m/s^2$ within the geographical zone, if the presence of an event decreasing the ground adhesion—such as a sheet of glass, oil slick, etc.—is detected within said geographical zone;

speed limit setpoint at 30 km/m and acceleration/deceleration limitation setpoint less than or equal to 1.5 $m/s^2$ within the geographical zone, if the presence of an event decreasing the ground adhesion—such as a sheet of glass, oil slick, etc.—is detected within said geographical zone;

limitation setpoint of the jerk vector when the vehicle 12 transports a so-called "fragile" person, such as an elderly person, a child or a person with reduced mobility, in order to avoid too great a jerk that could injure said person.

"Approaching the geographical zone" means that the respective vehicle 12 is located near said geographical zone, typically at a distance from said geographical zone that is below a predefined distance threshold, this distance threshold for example being between 100 m and 500 m, also preferably between 200 m and 400 m, still more preferably substantially equal to 300 m.

The sending module 54 is then configured to send the limitation setpoint(s) computed by the computing module 52 to the electronic supervision equipment items 16 via the corresponding datalink 18, 20.

As an optional addition, the acquisition module 56 is configured to acquire at least one setpoint computing rule, for example from an electronic apparatus, preferably from the electronic supervision equipment item 16. According to this optional addition, the computing module 52 is configured to compute the motion limitation setpoint further as a function of the at least one acquired computing rule acquired by the acquisition module 56. The acquired computing rule(s) are for example as previously defined.

As an optional addition, the communication device 58 is configured to switch the sending module 54 between a first sending mode according to which the sending module 54 transmits the computed limitation setpoint(s) to the electronic supervision equipment item 16 and the second sending mode according to which the sending module 54 transmits at least part of each tracking list to the electronic supervision equipment item 16.

The switching module 58 is for example configured to evaluate a charge of the data link 18, 20 between the sending module 54 and the electronic supervision equipment item 16, and to switch the sending module 54 to the first sending mode if a charge of the data link 18, 20 is detected above a predefined charge threshold. The predefined charge threshold is for example equal to 400 kilobytes.

In a variant, the predefined charge threshold corresponds to a maximum number of objects to be tracked. For example, the maximum number of objects to be tracked is equal to thirty. The switching module 58 is then configured to switch the sending module 54 to the first sending mode if a number of objects greater than said maximum number of objects to be tracked is detected.

As another optional addition, the switching module 58 is configured to switch the sending module 54 between the first sending mode and the second sending mode, upon receiving a request from a user. This request from the user for example results from manual pressure by the user on an activation member, not shown.

As another optional addition, the switching module 58 is configured to switch the sending module 54 between the first sending mode and the second sending mode, as a function of the geographical zone in question. According to this optional addition, the sending module 54 is for example authorized to be in the second sending mode only for a predefined set of specific geographical zone(s), and in the first sending mode otherwise, that is to say, when the relevant geographical zone is not included in this predefined set. Indeed, the second sending mode, according to which the sending module 54 sends at least part of each tracking list to the electronic supervision equipment item 16, makes it possible to provide the user with a finer analysis of this zone, which is for example useful in case of bypassing obstacle(s) in this zone, but represents a greater quantity of data to be transmitted over the datalink 18, 20. The second sending mode is then preferably reserved for only certain geographical zone (s), according to this optional addition.

In the second sending mode, the sending module 54 is configured to transmit, for each tracking list, a number of information elements less than or equal to a predetermined number of elements threshold. This number of elements threshold is typically adjustable by the user, for example from the electronic supervision equipment item 16. This number of elements threshold is for example adjustable as a function of the situation of a supervised vehicle 12, such as a normal situation or an obstacle bypass situation.

In the second sending mode, the sending module 54 is configured to transmit only part of each tracking list, the transmitted part of each tracking list comprising a number of information elements lower than the total number of information elements contained in said tracking list.

In the second sending mode, the sending module 54 is, as an optional addition, configured to sequence each tracking list according to a predetermined order of priority, then to transmit, according to said order of priority, the tracking lists to the electronic supervision equipment item 16.

The determining module 50 is, as an optional addition, and in particular if the sending module 54 is according to the second sending mode, configured to merge at least two tracking lists into one comprehensive tracking list. The merged tracking lists are then preferably associated with traffic elements 48 of the same type. The sending module 54 is then configured to transmit at least part of the comprehensive tracking list to the electronic supervision equipment item 16, according to the second sending mode.

The determining module 50 is, also as an optional addition, and in particular if the sending module 54 is according to the second sending mode, configured to merge at least two detected traffic elements 48, preferably of the same type, into one group of traffic elements 48, and then to determine a common tracking list for said group of tracking elements 48. The sending module 54 is then configured to transmit at least part of the common tracking list to the electronic supervision equipment item 16, according to the second sending mode.

Figure 2:
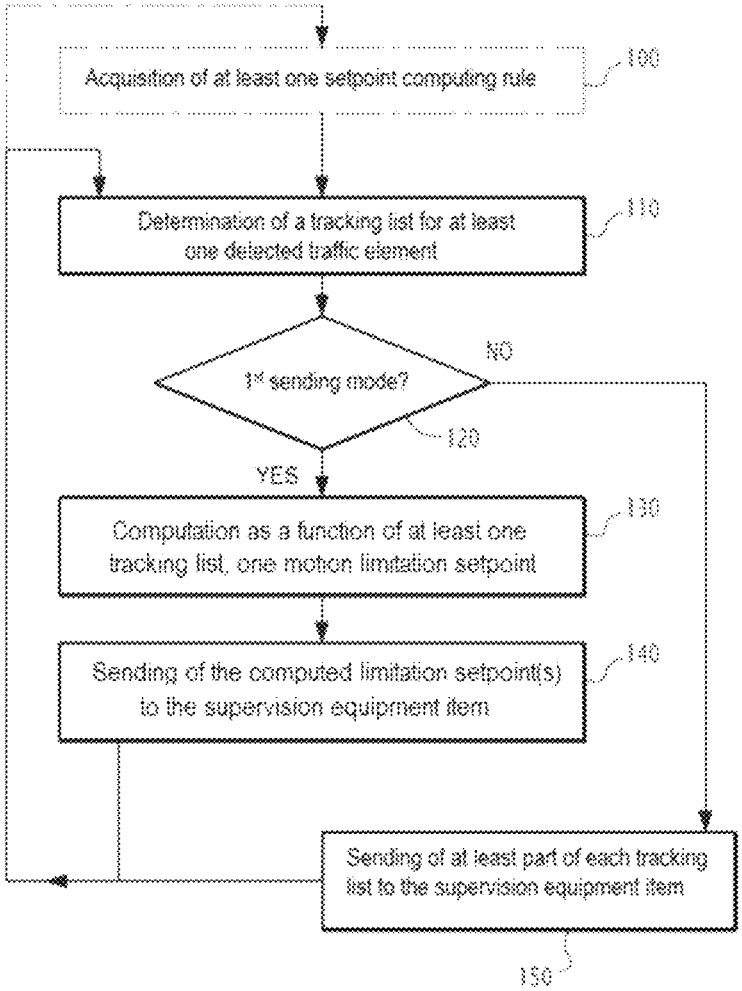
FIG. 2 is a flowchart of a communication method according to the invention implemented by the electronic communication device of FIG. 1.

The operation of the electronic communication device 30 according to the invention will now be explained using FIG. 2 showing a flowchart of the communication method according to the invention, the method being implemented by the electronic communication device 30.

During an optional initial step 100, the electronic communication device 30 acquires, via its acquisition module 56, at least one setpoint computing rule, from an electronic apparatus, preferably from the electronic supervision equipment item 16.

The communication device 30 determines, during step 110 and via its determining module 50, the tracking list for at least one traffic element 48 detected by the sensor 28, each tracking list including several information elements, the traffic element 48 being located within a geographical zone covered by the sensor 28.

When, as an optional addition, the communication device 30 further comprises the switching module 58 of the sending module 54 between the first and second sending modes, the communication device 30 then tests, during step 120 and via its switching module 58, whether the sending module 54 is according to the first sending mode, or on the contrary according to the second sending mode.

If the test step 120 is positive, that is to say, if the sending module 54 is according to the first sending mode, then the communication device 30 goes to step 130, during which it computes, via the computing module 52 and as a function of at least one tracking list determined during step 110, the motion limitation setpoint for each vehicle 12 located in the respective geographical zone.

One skilled in the art will further understand that if the communication device 30 does not comprise a switching module 58, then step 120 is not carried out, and the communication device 30 goes directly from the determining step 110 to the computing step 130. In other words, step 120 is optional and conditioned by the presence of the switching module 58 within the communication device 30.

Following the computing step 130, the communication device 30 sends, during step 140 and via its sending module 54, the computed limitation setpoint(s) to the electronic supervision equipment items 16 via the datalink 18, 20. This sending then corresponds to the first sending mode when the communication device 30 further comprises the switching module 58.

At the end of step 140, the supervision equipment 16 then receives, via its receiving module 34 and from the monitoring apparatus 14 to which it is coupled and including said communication device 30, the limitation setpoint computed by the computing module 52, then sent by the sending module 54.

The electronic supervision equipment item 16 then establishes, via its establishing module 36, the resulting motion limitation setpoint for the corresponding geographical zone, from the motion limitation setpoint(s) received for said geographical zone, from the respective surveillance apparatus or apparatuses 14.

The electronic supervision equipment item 16 lastly transmits, via its transmission module 38, the setpoint(s) established for the respective motor vehicle(s) 12, in particular those located in said geographical zone, that is to say, positioned within said geographical zone.

If the test step 120 is negative, that is to say, if the sending module 54 is according to the second sending mode, then the communication device 30 goes to step 150 during which it sends, via its sending module 54 and according to the second sending mode, at least part of each tracking list to the electronic supervision equipment items 16.

According to this second sending mode, the sending module 54 typically transmits, for each tracking list, a number of information elements less than or equal to the predetermined number of elements threshold, this threshold being adjustable by the user, typically as a function of the situation (normal, obstacle bypass, etc.) of the supervised vehicle 12.

According to this second sending mode, the transmitted part of each list then preferably comprises a number of information elements lower than the total number of information elements contained in said tracking list.

According to this second sending mode, the sending module 54 optionally sequences each tracking list according to the predetermined order of priority, then transmits the tracking lists to the electronic supervision equipment items 16 according to said order.

According to this second sending mode and as an optional addition, the determining module 50 merges at least two tracking lists into one comprehensive list, the merging for example being done by type of traffic element 48. If applicable, the sending module 54 then transmits, during step 150, at least part of the comprehensive tracking list to the electronic supervision equipment item 16.

According to this second sending mode and as another optional addition, the determining module 50 merges at least two detected traffic elements 48, preferably of the same type, into one group of traffic elements 48, and then determines the common tracking list for said group of traffic elements 48. If applicable, the sending module 54 then transmits, during step 150, at least part of the common tracking list to the electronic supervision equipment item 16.

At the end of step 150, the electronic supervision equipment 16 then receives, via its receiving module 34 and from the monitoring apparatus 14 to which it is coupled and including said communication device 30, each part of each tracking list sent by the respective sending module 54.

The electronic supervision equipment item 16 then establishes, via its establishing module 36, the resulting motion limitation setpoint for the corresponding geographical zone, from the tracking list part(s) received for said geographical zone, from the respective surveillance apparatus or apparatuses 14.

The electronic supervision equipment item 16 lastly transmits, via its transmission module 38, the setpoint(s) established for the respective motor vehicle(s) 12, in particular those located in said geographical zone, that is to say, positioned within said geographical zone.

At the end of step 140 or 150, the communication device returns to the acquisition step 100 if a new setpoint computing rule must be acquired, and to the determining step 110 otherwise.

Thus, the electronic communication device 30 according to the invention makes it possible, through the computing module 52, to compute a motion limitation setpoint for each vehicle located in the geographical zone and as a function of at least one tracking list determined by the determining module 50. The sending module 54 next makes it possible to send the computed limitation setpoint(s) to the supervision equipment item 16.

The quantity of information thus transmitted to the supervision equipment item 16 is then reduced relative to a communication device of the state of the art transmitting all of the information elements contained in the determined tracking list(s). Each motion limitation setpoint indeed has a data size, for example expressed in bits or bytes, smaller than the size of the tracking list(s) from which it is calculated.

The communication device 30 according to the invention is then particularly advantageous in the zones having a large number of obstacles, in particular the zones where many vehicles 12 and pedestrians cohabitate.

When, as an optional addition, the communication device 30 further comprises the switching module 58, this makes it possible to provide the user with a finer analysis of the geographical zone and/or for a given time period, which is for example useful in case of obstacle bypass in this zone, by transmitting—according to the second sending mode and via the sending module 54—at least part of each tracking list to the electronic supervision equipment item 16.

Since this sending according to the second mode represents a greater quantity of data to be transmitted over the datalink 18, 20, the second sending mode is then preferably reserved for only certain geographical zone(s) and/or certain given time period(s).

Furthermore, the switching module 58 regularly evaluates the charge of the datalink 18, 20 between the sending module 54 and the electronic supervision equipment item 16, and then switches the sending module 54 to the first sending mode if a charge of the data link 18, 20 is detected above the predefined charge threshold, so as not to saturate said datalink 18, 20.

For greater usage flexibility, the switching between the first sending mode and the second sending mode, in particular to the second sending mode, is also able to be activated directly by the user, while having the possibility of automatically switching back to the first sending mode in case of overload of the datalink 18, 20.

One can thus see that the switching device 30 according to the invention is more effective, even in case of a large number of obstacles in the zone where the vehicle 12 is traveling.

What is claimed is:

1. An electronic communication device able to be coupled to a sensor and intended to be installed in the road infrastructure or embedded in a vehicle, the communication device comprising:

a determining module configured to determine a tracking list for at least one traffic element detected by the sensor, each tracking list including several information elements, the traffic element being located within a geographical zone covered by the sensor, a computer configured to compute, as a function of at least one determined tracking list, a motion limitation setpoint for each vehicle located in the geographical zone; and a transmitter configured to send the computed limitation setpoint(s) to an electronic supervision equipment item via a data link, the electronic supervision equipment item being able to remotely supervise, or remotely monitor, a fleet of the vehicle(s), wherein the transmitter is configured to operate in a first sending mode according to which the transmitter transmits the computed limitation setpoint(s) to the electronic supervision equipment item.

2. The device according to claim 1, wherein the communication device further comprises an acquisition module configured to acquire at least one setpoint computing rule, from an electronic apparatus; and the computer is configured to compute the motion limitation setpoint further as a function of the at least one acquired computing rule.

3. The device according to claim 2, wherein the electronic apparatus is the electronic supervision equipment item.

4. The device according to claim 1, wherein the motion limitation setpoint is chosen from the group consisting of: a speed limitation setpoint; an acceleration limitation setpoint; and a speed and acceleration limitation setpoint.

5. The device according to claim 1, wherein the determining module is configured to determine, for each traffic element, at least one information element chosen from the group consisting of:

the type of traffic element, such as pedestrian, stationary obstacle, motor vehicle or bicycle;

the position of the traffic element;

at least one dimension of the traffic element;

a speed of the traffic element;

an acceleration/deceleration of the traffic element; and a confidence index associated with the traffic element.

6. The device according to claim 1, wherein the communication device further comprises a switch configured to switch the transmitter between the first sending mode and a second sending mode according to which the transmitter transmits at least part of each tracking list to the electronic supervision equipment item.

7. The device according to claim 6, wherein the switch is configured to evaluate a charge of the data link between the transmitter and the electronic supervision equipment item, and to switch the transmitter to the first sending mode if a charge of the data link is detected above a predefined charge threshold.

8. A monitoring apparatus comprising a sensor and an electronic communication device able to be coupled to said sensor, the communication device being according to claim 1.

9. A supervision installation of a transport system including at least one motor vehicle, the supervision installation comprising:

at least a monitoring apparatus intended to be installed in the road infrastructure or on a corresponding motor vehicle; and an electronic supervision equipment item coupled to each monitoring apparatus, the supervision equipment item being configured to transmit at least one instruction to a respective motor vehicle;

wherein at least one monitoring apparatus is according to claim 8.

10. The supervision installation according to claim 9, wherein the electronic supervision equipment item is configured to establish a resulting motion limitation setpoint for a geographical zone from one or several motion limitation setpoints received for said geographical zone.

11. A communication method implemented by an electronic communication device able to be coupled to a sensor and intended to be installed in the road infrastructure or embedded in a vehicle, the method comprising:

determining a tracking list for at least one traffic element detected by the sensor, each tracking list including several information elements, the traffic element being located within a geographical zone covered by the sensor, computing, as a function of at least one determined tracking list, a motion limitation setpoint for each vehicle located in the geographical zone; and sending the computed limitation setpoint(s) to an electronic supervision equipment item via a data link, the electronic supervision equipment item remotely supervising, or remotely monitoring, a fleet of the vehicle(s).

12. A non-transitory computer readable medium including a computer program including software instructions which, when implemented by a computer, implement a method according to claim 11.

* * * * *